US006880177B2

(12) United States Patent
Sung

(10) Patent No.: US 6,880,177 B2
(45) Date of Patent: Apr. 19, 2005

(54) ERGONOMIC SWIMMING GOGGLES

(76) Inventor: Hsiu-Ying Sung, P.O. Box. 26-757, Taipei (TW)

( * ) Notice: Subject to any disclaimer, the term of this patent is extended or adjusted under 35 U.S.C. 154(b) by 144 days.

(21) Appl. No.: 10/371,936

(22) Filed: Feb. 17, 2003

(65) Prior Publication Data

US 2004/0158916 A1 Aug. 19, 2004

(51) Int. Cl.[7] ..... A61F 9/02
(52) U.S. Cl. ..... 2/440
(58) Field of Search ..... 2/426, 428, 440, 2/442, 445, 446

(56) References Cited

U.S. PATENT DOCUMENTS 6,052,834 A * 4/2000 Chou ..... 2/428

D451,118 S * 11/2001 Husband ..... D16/311

* cited by examiner

*Primary Examiner*—Gary L. Welch
*Assistant Examiner*—Brian Kauffman
(74) *Attorney, Agent, or Firm*—Rosenberg, Klein & Lee

(57) ABSTRACT

A pair of ergonomic swimming goggles worn at the head to cover eye sockets has two lens bodies, two linings, a bridge component and a goggles band. The linings have firm joint portions annularly disposed at peripheries of the lens bodies. The region of the firm joint portions corresponding to deeper portions of the eye sockets is thicker, while the region of the firm joint portions corresponding to shallower regions of the eye sockets is thinner. Elastic portions extend from the firm joint portions. The extension width of the elastic portions corresponding to the thicker region of the firm joint portions is narrower, while the extension width of the elastic portions corresponding to the thinner region of the firm joint portions is wider. Thereby, the pair of ergonomic swimming goggles can fully seal and comfortably cover the peripheries of the eye sockets.

5 Claims, 4 Drawing Sheets

ERGONOMIC SWIMMING GOGGLES

BACKGROUND

1. Field of the Invention

The present invention relates to a pair of ergonomic swimming goggles and, more particularly, to a pair of ergonomic swimming goggles having peripheries of eye socket-sticking sides designed according to eye socket depth.

2. Description of Related Art

Swimming is a healthy and widely practiced sport, for which swimming goggles are one of the most commonly used equipment. Their primary function is to protect human eyes. They can separate eyes from water to avoid discomfort due to lengthy immersion in unclean water or harm caused by contaminants in the water. Nowadays, safety and sanitation are greatly valued and self-protection at open water-friendly places like public swimming pools is especially necessary to avoid transmission of various kinds of disease media through water.

A pair of conventional swimming goggles comprises a pair of lens bodies, two linings, a bridge component and a goggles band. The two lens bodies are left and right symmetric. Each lens body further comprises a lens portion. The periphery of the lens portion extends to the eye socket-sticking side of the swimming goggles to form a side frame portion. Lock ears and goggles band holes are provided at the adjacent ends and the distant ends of the left and right lens bodies, respectively. Slanting protuberances are provided at two sides of the bridge component. Two ends of the bridge component pass through the lock ears of the left and right lens bodies to fasten the protuberances to the lock ears and adjust the distance between the two lens bodies. Two ends of the goggles band pass through and are connected to the goggles band holes of the two lens bodies. Each of the linings has a firm joint portion, which is annularly disposed at the periphery of the side frame portion of the lens body. An elastic portion is also extended from the firm joint portion. The elastic portion is located at the eye socket-sticking side of the lens body. Both the thickness of the firm joint portion and the width of the elastic portion are designed to be uniform.

In the above conventional swimming goggles, the thickness of the firm joint portions of the linings is uniform, and the width of the elastic portions is also uniform. The eye socket of the human body, however, has a curved shape with different depths. As a result, the linings cause uncomfortable compression in shallow areas of eye sockets and fail to create an airtight seal in deep areas of eye sockets, allowing permeation and possible contamination of the wearer's eyes.

SUMMARY OF THE INVENTION

The primary object of the present invention is to provide a pair of ergonomic swimming goggles, which can tightly cover the peripheries of eye sockets to prevent water leakage while simultaneously avoiding improper compression of eye sockets for greater comfort during wear.

To achieve the above object, the present invention provides a pair of ergonomic swimming goggles. The pair of ergonomic swimming goggles comprises two lens bodies, two linings, a bridge component and a goggles band. Each of the two linings has a firm joint portion annularly disposed at the periphery of the lens body. The region of the firm joint portions corresponding to the deeper regions of eye sockets is thicker, while the region of the firm joint portions corresponding to the shallower regions of eye sockets is thinner. Elastic portions extend from the firm joint portions. The elastic portions are located at the eye socket-sticking sides of the lens bodies. Two ends of the bridge component are connected to adjacent ends of the two lens bodies. Two ends of the goggles band are connected to distant ends of the two lens bodies.

In the present invention, the thickness of the firm joint portions of the linings is designed to match the depth of eye sockets so that the pair of ergonomic swimming goggles can fully seal and comfortably cover the periphery of the eye sockets. Moreover, the extension width of the elastic portions of the linings corresponding to the thicker region of the firm joint portions is narrower, while the extension width of the elastic portions of the linings corresponding to the thinner region of the firm joint portions is wider, hence allowing more comfortable contact between the ergonomic swimming goggles and a wearer's face.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
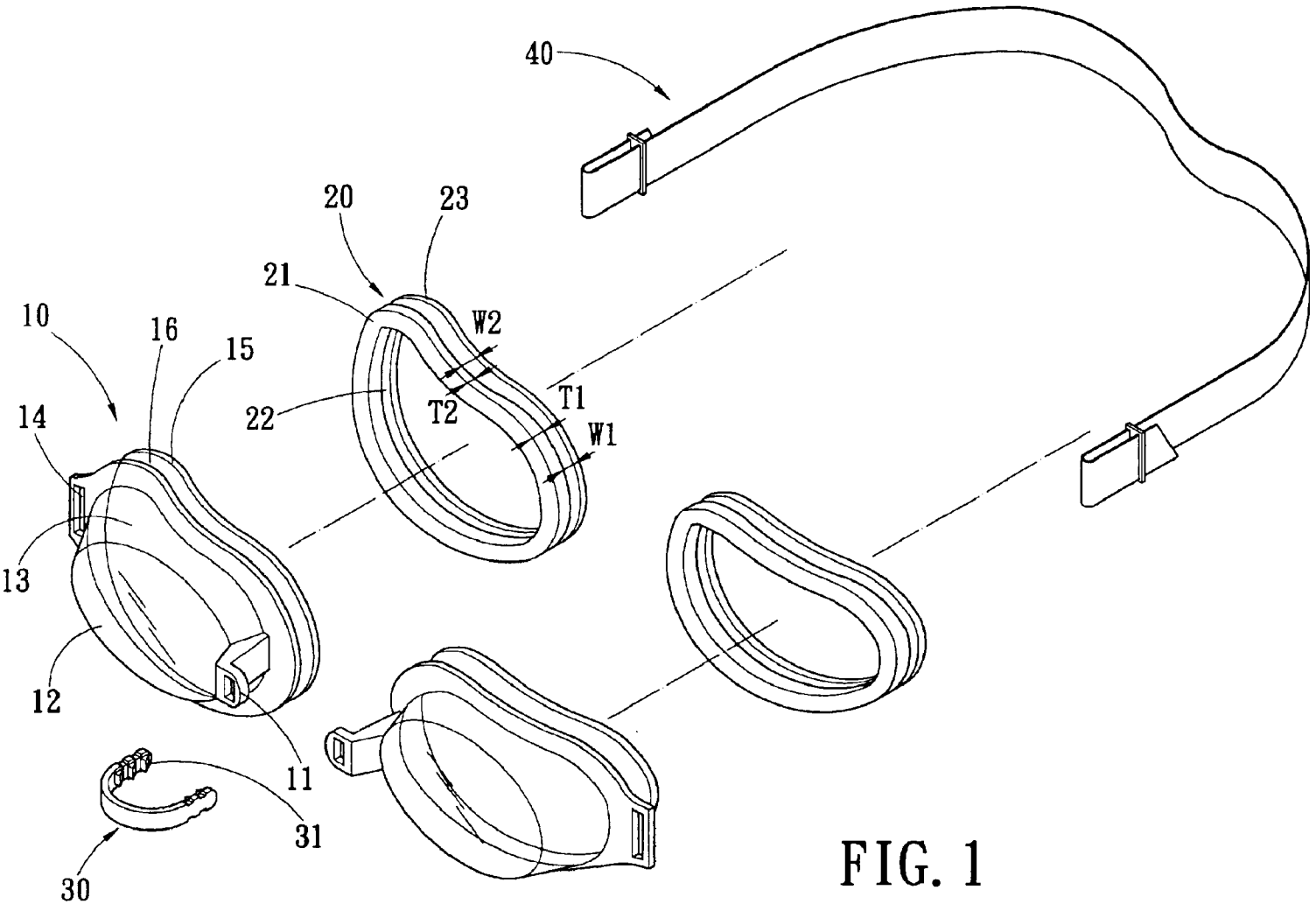
FIG. 1 is an exploded perspective view of a pair of ergonomic swimming goggles of the present invention.
Figure 2:
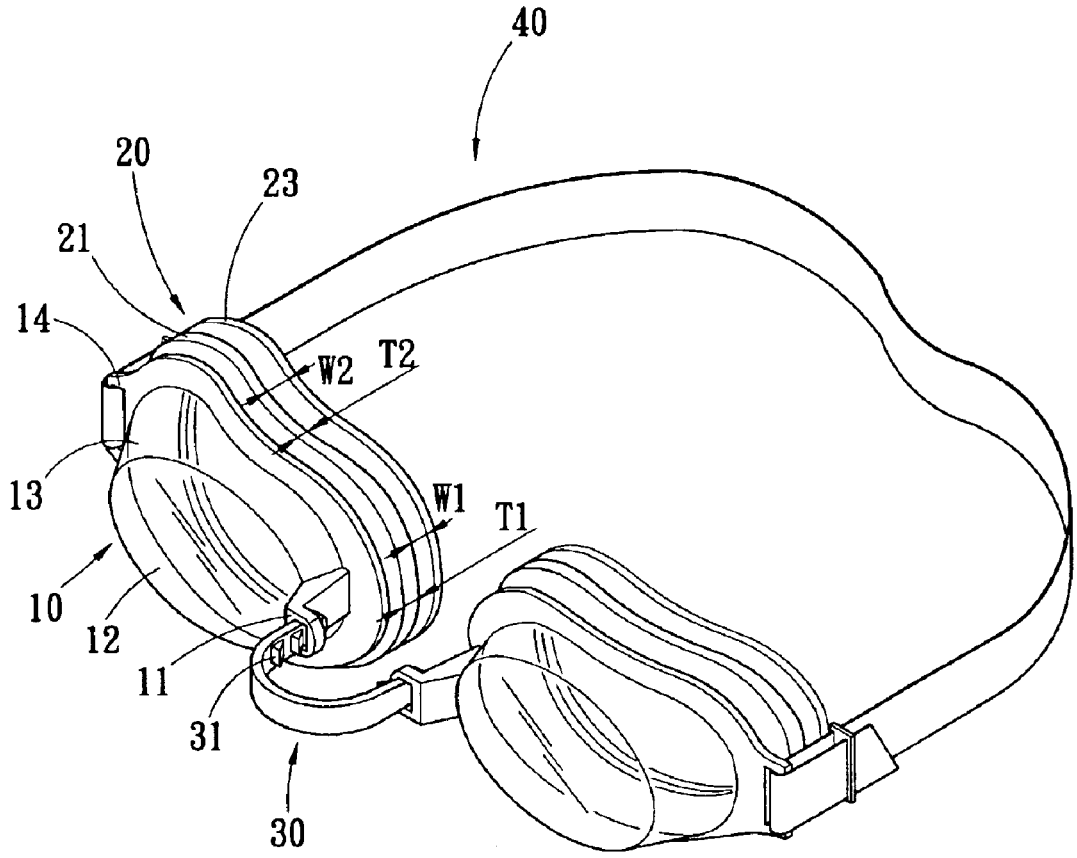
FIG. 2 is a perspective assembly view of a pair of ergonomic swimming goggles of the present invention.
Figure 3:
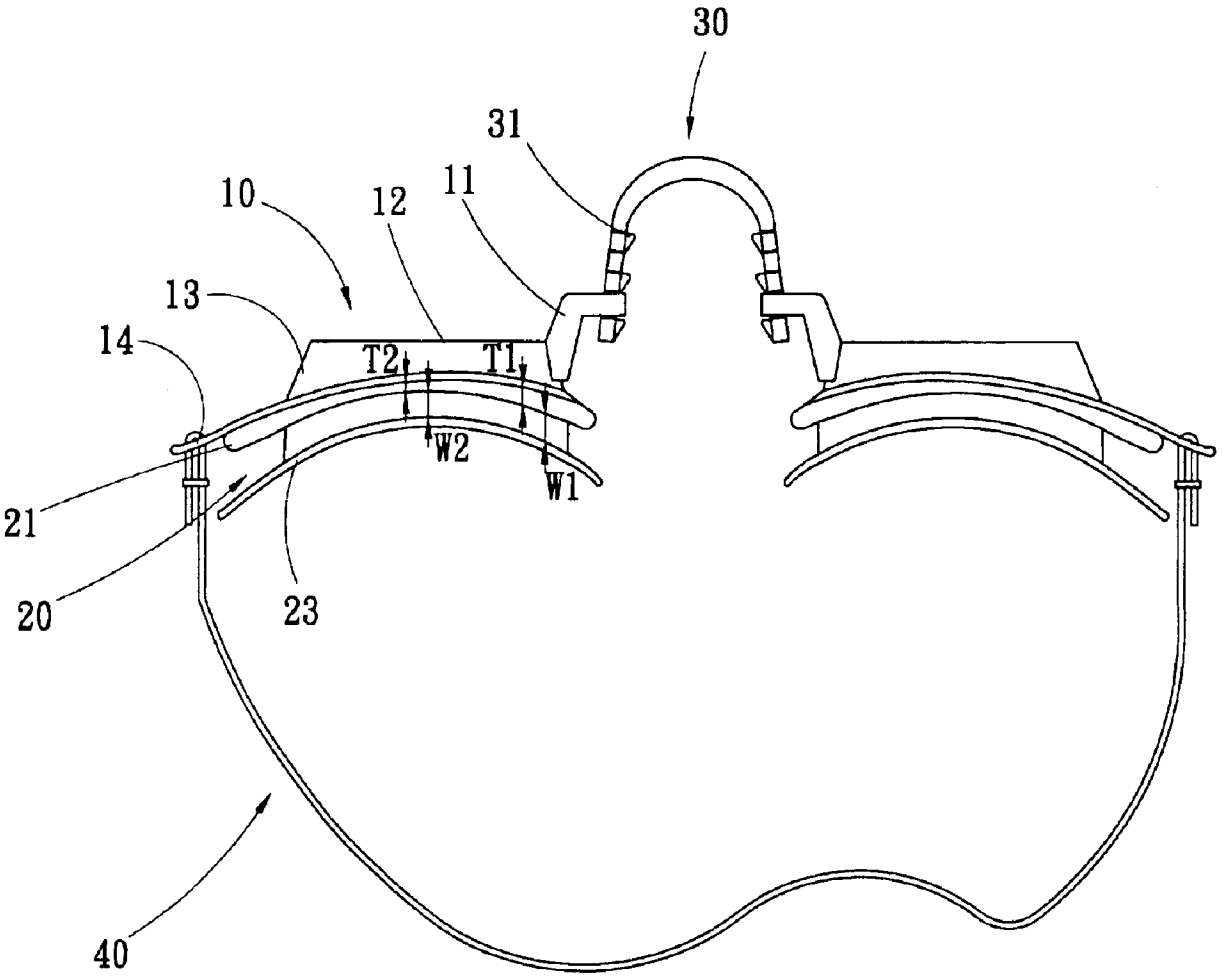
FIG. 3 is a top view of a pair of ergonomic swimming goggles of the present invention.
Figure 4:
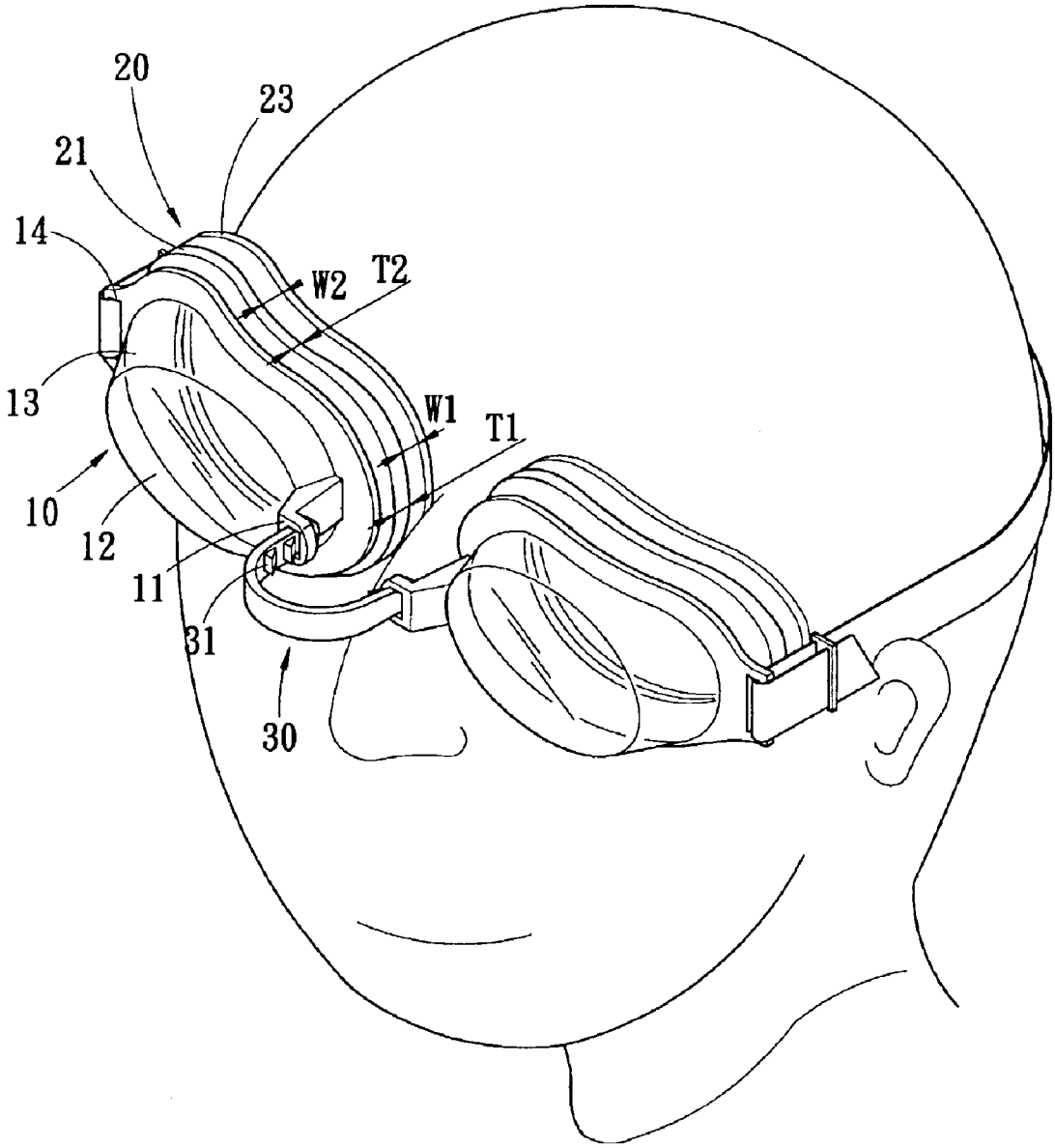
FIG. 4 is a diagram showing how to wear a pair of ergonomic swimming goggles of the present invention.

As shown in FIGS. 1 to 4, a pair of ergonomic swimming goggles of the present invention comprises two lens bodies 10, two linings 20, a bridge component 30 and a goggles band 40.

The lens bodies 10 are made of transparent or translucent plastic material, and are left and right symmetric. Lock ears 11 are provided at the adjacent ends of the left and right lens bodies 10. Each of the lens bodies 10 has a lens portion 12. Side frame portions 13 extend from the peripheries of the lens portions 12 to the eye socket-sticking sides of the swimming goggles. Goggles band holes 14 are provided at the side frame portions 13 at the distant ends of the left and right lens bodies 10. Flanges 15 are provided at the peripheries of the side frame portions 13 of the lens bodies 10. Grooves 16 are formed between the flanges 15 and the side frame portions 13.

Each of the linings 20 has a firm joint portion 21. Grooves 22 are provided at the inner edges of the firm joint portions 21. The grooves 22 are fastened to the flanges 15 of the lens bodies 10 to let the firm joint portions 21 be annularly disposed at the peripheries of the side frame portions 13 of the lens bodies 10. The thickness T1 of the region of the firm joint portions 21 corresponding to the eye sockets of larger depth is larger, while the thickness T2 of the region of the firm joint portions 21 corresponding to the eye sockets of smaller depth is smaller. An elastic portion 23 extends from each of the firm joint portions 21. The elastic portions 23 are located at the eye socket-sticking sides of the lens bodies 10. The elastic portions 21 extend in a curved shape from the firm joint portions 21 to the outer side direction of the peripheries of the lens bodies 10. The extension width W1 of the elastic portions 23 corresponding to the thicker region of the firm joint portions 21 is narrower, while the extension width W2 of the elastic portions corresponding to the thinner region of the firm joint portions 21 is wider.

Two ends of the bridge component 30 are connected to the adjacent ends of the two lens bodies 10. Slanting protuberances 31 are provided at two sides of the bridge component 30. The two ends of the bridge component 30 pass through the lock ears 11 of the left and right lens bodies 10 to fasten the protuberances 31 to the lock ears 11 and adjust the distance between the two lens bodies 10.

Two ends of the goggles band 40 pass through and are connected to the goggles band holes 14 at the distant ends of the two lens bodies 10.

In the ergonomic swimming goggles of the present invention, the linings 20 are disposed at the peripheries of the side frame portions 13 of the lens bodies 10. The linings 20 are slipped onto the peripheries of the lens bodies 10 with the firm joint portions 21 thereof. The elastic portions 23 then extend from the firm joint portions 21. The firm joint portions 21 and the elastic portions 23 are made of the same material. Deformation of the firm joint portions 21 is limited because the same are slipped onto the lens bodies 21. The thickness of the firm joint portions 21 is designed according to the depth of the eye sockets. The region of the firm joint portions 21 where the eye sockets are deeper is thicker, while the region the firm joint portions 21 where the eye sockets are shallower is thinner, hence allowing the peripheries of the lens bodies 10 keep a uniform and appropriate distance from the eye sockets. On the other hand, the deformation of the elastic portions 23 is less limited. The whole elastic portions 23 can uniformly and properly deform. The thickness of the firm joint portions 21 of the linings 20 is designed according to the depth of the eye sockets so that the ergonomic swimming goggles can fully seal and comfortably cover the peripheries of the eye sockets. Moreover, the elastic portions can completely press the eye sockets without the problem of excessive compression in shallower regions of the eye sockets or a poor seal in deeper regions of the eye sockets. Therefore, the ergonomic swimming goggles of the present invention prevent a wearer's eyes from threat of water leakage and also avoid a feeling of compression so as to along comfortable and extended wear while engaging in aquatic activities.

In conclusion, the ergonomic swimming goggles of the present invention have the following characteristics:

(1) The thickness of the firm joint portions of the linings is designed according to the depth of the eye sockets. The region of the firm joint portions in deeper areas of the eye sockets is thicker, while the region of the firm joint portions in shallower areas of the eye sockets is thinner. Therefore, shallower regions of the eye sockets are not excessively compressed, and deeper regions of the eye sockets are still airtight The ergonomic swimming goggles of the present invention are accordingly more comfortable and and water resistant.

(2) The width of the elastic portions of the linings corresponding to the thicker region of the firm joint portions is narrower, while the width of the elastic portions corresponding to the thinner region of the firm joint portions is wider, hence letting the ergonomic swimming goggles of the present invention more comfortably press a wearer's eye sockets.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

REFERENCE NUMERALS

Present invention

10: lens body
11: lock ear
12: lens portion
13: side frame portion
14: goggles band hole
15: flange
16: groove
20: lining
21: firm joint portion
22: groove
23: elastic portion
30: bridge component
31: protuberance
40: goggles band
T1: thickness of the region of the firm joint portions corresponding to the eye sockets of smaller depth
T2: thickness of the region of the firm joint portions corresponding to the eye sockets of smaller depth
W1: extension width of the elastic portions corresponding to the thicker region of the firm joint portions
W2: extension width of the elastic portions corresponding to the thinner region of the firm joint portions

I claim:

1. A pair of ergonomic swimming goggles worn to cover peripheries of eye sockets, comprising:

two lens bodies;

two linings, each having a firm joint portion, wherein said firm joint portions are annularly disposed at peripheries of said lens bodies, a region of said firm joint portions corresponding to deeper portions of eye sockets is thicker, a region of said firm joint portions corresponding to shallower portions of eye sockets is thinner, elastic portions extend from said firm joint portions, and said elastic portions are located at eye socket-sticking sides of said lens bodies;

wherein an extension width of said elastic portions of said linings corresponding to the thicker region of said firm joint portions is narrower, while an extension width of said elastic portions of said linings corresponding to the thinner region of said firm joint portions is wider;

a bridge component, wherein two ends thereof are connected to adjacent ends of said two lens bodies; and a goggles band, wherein two ends thereof are connected to distant ends of said two lens bodies;

whereby said pair of ergonomic swimming goggles can fully seal and comfortably cover the peripheries of the eye sockets because a thickness of said firm joint portions of said linings is designed to match a depth of the eye sockets.

2. The pair of ergonomic swimming goggles as claimed in claim 1, wherein said elastic portions extend in a curved shape from said firm joint portions to an outer side direction of the peripheries of said lens bodies.

3. The pair of ergonomic swimming goggles as claimed in claim 1, wherein said lens bodies have lens portions, side frame portions extend from the peripheries of said lens portions to the eye socket-sticking sides of said pair of swimming goggles, flanges are provided at peripheries of said side frame portions of said lens bodies, grooves are formed between said flanges and said side frame portions, and said flanges of said lens bodies are fastened to grooves provided at inner edges of said firm joint portions of said linings.

4. The pair of ergonomic swimming goggles as claimed in claim 3, wherein goggles band holes are provided in said side frame portions at distant ends of said two lens bodies, and two ends of said goggles band pass through and are connected to said goggles band holes.

5. The pair of ergonomic swimming goggles as claimed in claim 1, wherein lock ears are provided at adjacent ends of said two lens bodies, slanting protuberances are provided at two sides of said bridge component, two ends of said bridge component pass through said lock ears, and said protuberances are fastened to said lock ears to adjust the distance between said two lens bodies.

* * * * *